US005279228A

United States Patent [19]

Ayer

[11] Patent Number: 5,279,228

[45] Date of Patent: Jan. 18, 1994

[54] SHAPED CHARGE PERFORATOR

[75] Inventor: Douglas E. Ayer, Nashua, N.H.

[73] Assignee: Defense Technology International, Inc., Nashua, N.H.

[21] Appl. No.: 872,458

[22] Filed: Apr. 23, 1992

[51] Int. Cl.[5] ..... F42B 1/032

[52] U.S. Cl. ..... 102/306

[58] Field of Search ..... 102/306, 307, 308, 309, 102/310, 476

[56] References Cited

U.S. PATENT DOCUMENTS

| | | | |
|---|---|---|---|
| 3,136,249 | 6/1964 | Poulter | 102/309 |
| 3,255,659 | 6/1966 | Venghiattis | 102/306 |
| 4,441,428 | 4/1984 | Wilson | 102/307 |
| 4,519,313 | 5/1985 | Leidel | 102/310 |
| 4,592,790 | 6/1986 | Globus | 102/306 |
| 4,766,813 | 8/1988 | Winter et al. | 102/307 |
| 4,784,061 | 11/1988 | Christopher | 102/306 |
| 4,860,654 | 8/1989 | Chawld et al. | 102/306 |
| 4,966,750 | 10/1990 | LaSalle et al. | 102/501 |
| 5,119,729 | 6/1992 | Nguyen | 102/307 |

FOREIGN PATENT DOCUMENTS

| | | | |
|---|---|---|---|
| 437992 | 7/1991 | European Pat. Off. | 102/306 |
| 2553245 | 6/1977 | Fed. Rep. of Germany | 102/476 |

OTHER PUBLICATIONS

Jackson et al, Processing and Properties of High--Purity, Fine-Grain-Size Depleted-Uranium, Deep--Drawn Shapes, Oct. 29, 1980, pp. 1-35.

G. Birkhoff et al., *Journal of Applied Physics*, vol. 19, pp. 563-582 (Jun., 1948).

M. Cook, *The Science of High Explosives*, Chapter 10, Reinhold Publishing Corp., New York (1958).

*Primary Examiner*—Stephen C. Bentley

*Attorney, Agent, or Firm*—Synnestvedt & Lechner

[57] ABSTRACT

Shaped charge perforators are provided which include a metal tube having a first closed end and containing a high energy explosive. The closed end includes a detonation device for providing an initiation charge to the high energy explosive. The tube further includes, at its unconstrained end, a liner comprising a liner metal having a density greater than about 10 g/cc. The liner forms a depression in the exposed end of the metal tube.

18 Claims, 3 Drawing Sheets

SHAPED CHARGE PERFORATOR

FIELD OF THE INVENTION

This invention relates to explosive charges commonly employed in freeing deposits from oil and gas wells, and especially to perforating, explosive charge devices adaptable to create fissures and holes in oil and gas deposit substrates.

BACKGROUND OF THE INVENTION

Following drilling operations, oil and gas producers are often faced with the problem of freeing deposits from the well hole site. Since many of the easily obtainable energy sources have already been harvested, a large number of the remaining sites are trapped within hard rock and sandstone substrates. Such wells are often abandoned because of an inability to perforate these down-hole geological formations. Improved means for enhancing penetration, therefore, would be expected to result in a significant economic gain in oil and gas production.

The art has previously resorted to shaped explosive charges for perforating the solid rock to reach these otherwise inaccessible reserves. These charges have been known to create fissures in the deposit substrates, whereby channels are generated between the oil and gas reservoirs and the well bore. In most of the commercially-available shaped charges, a metal tube containing a common explosive material, such as C6, is provided with an initiating charge containing, for example, a simple cylindrical pellet booster. A conically-shaped metal liner is inserted into the front of the tube and into the explosive material for aiding penetration into the hard rock formations upon detonation of the charge. Such liners typically employ a soft ductile, low density metal, such as copper or iron. The principles of shaped charge functioning are well known, and are described in G. Birkhoff et al., *Journal of Applied Physics*, Vol. 19, p. 563–82 (June, 1948), and M. Cook, *The Science of High Explosives*, Chapter 10, Reinhold Publishing Corp., New York (1958), which are hereby incorporated by reference.

The penetration of a shaped charge into a solid hard rock formation is known to be governed by the following calculation, hereinafter referred to as the "penetration formula".

$$P = l\left(\frac{P_i}{P_m}\right)^{\frac{1}{2}} \times K$$

Where

P = penetration into a given target in units of distance l = the length of the metal jet $P_i$ = the density of the jet metal in g/cc $P_m$ = the density of the material being penetrated in g/cc From this equation, it is clear that by maximizing the ratio of the metal jet density, "$P_i$", to the target density, "$P_m$", a greater penetration, "P", into the formation can successfully be achieved. Additionally, greater ductility is also important, since it is directly related to the length, "l", of the jet. Finally, the factor "K" in the above equation relates to the explosion system considerations for a given charge, such as its explosive impetus, which provides yet another factor for optimizing perforator designs.

Accordingly, there is a need for a more effective charge design which permits higher perforation of hard rock geological deposits during oil and gas recovery operations. There is also a need for improved liner materials, and more effective charge initiation schemes.

SUMMARY OF THE INVENTION

Shaped charge perforators are provided by this invention which include a metal tube having an open and closed end. The tube includes a high energy explosive for maximizing the explosive impetus of the charge. The closed end of the tube contains a detonation device for providing an initiating charge to the high energy explosive. The open end contains a concave liner made of a "heavy metal" having a density greater than about 10 g/cc. Such a density is far greater than traditional materials, such as copper and steel, which helps to maximize the penetration formula for a given amount of explosive.

Accordingly, the relative density between the jet metal and the hard rock to be penetrated is overmatched by the perforators of this invention to achieve the greatest amount of penetration of targets. This invention also preferably provides high energy HMX military explosives which further increase the explosion K factor to maximize penetration. The liner metal can also be provided with a fine grain microstructure, by, for example, cold working or hot isostatic pressing techniques, for increasing the ductility of the metal and maximizing the length of the metal jet.

In other embodiments of this invention, methods of manufacturing shaped charge perforators are provided which include providing a metal tube having an open and closed end, inserting a high energy explosive within the tube, attaching a detonation device to the closed end of the tube and a high density metallic liner having a concave configuration into the explosive at the open end.

BRIEF DESCRIPTION OF THE DRAWINGS

The accompanying drawings illustrate preferred embodiments of this invention according to the practical application of the principals thereof, and in which.

DETAILED DESCRIPTION OF THE INVENTION

Figure 1:
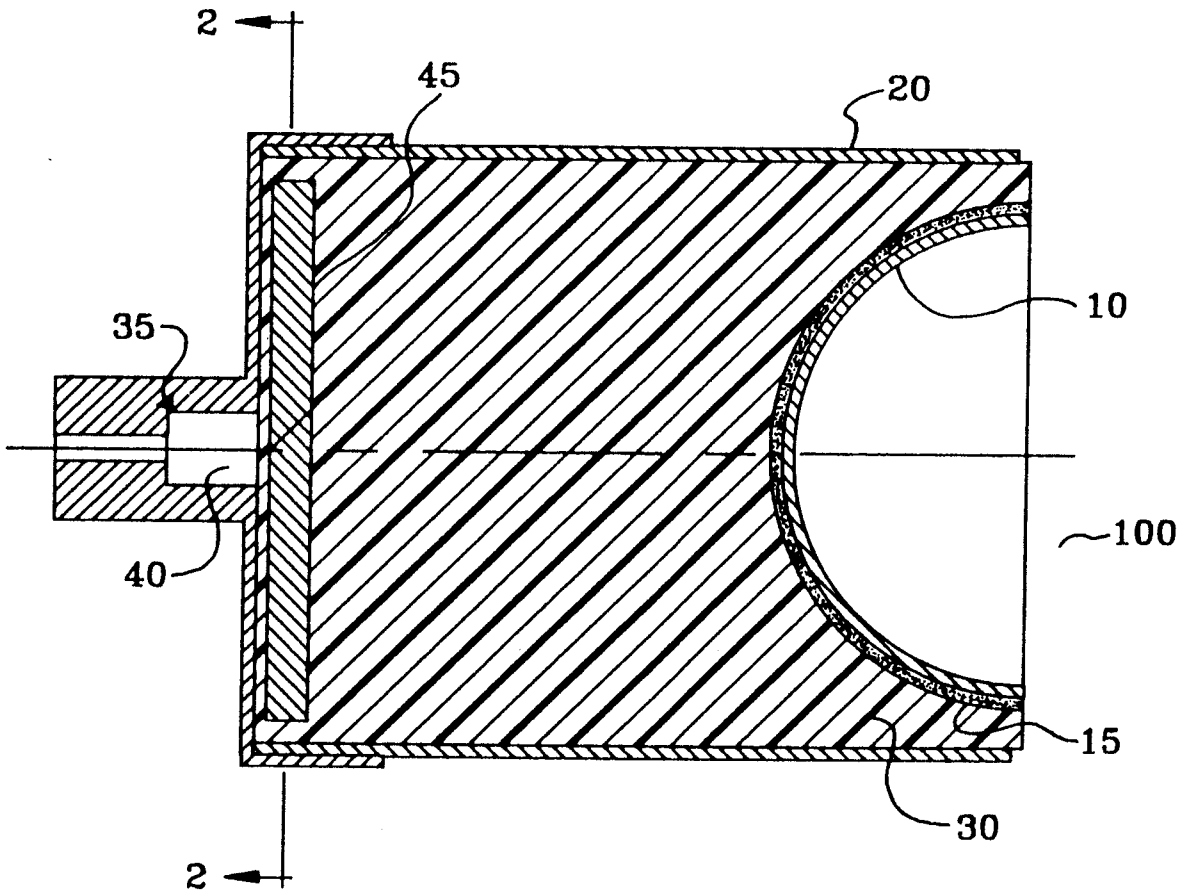
FIG. 1 is a side, cross-sectional view of a preferred shaped charge perforator of this invention.

With reference to the figures, and particularly FIG. 1, there is shown a preferred shaped charge perforator 100 of this invention. The perforator 100 includes a metal tube 20 containing a high energy explosive 30. At one end of the tube 20 is a preferred detonation device which includes an initiation charge 45, optional booster charge compartment 40, and a metal detonator holder 35. At the open, or second, end of the metal tube 20 is a preferred liner 10. The liner 10 is shown as a hemispherical, convex shaped, metallic member adhesively bound with resin adhesive composition 15 to the end of the high energy explosive 30.

The shaped charge designs of this invention provide enhanced well perforation over prior art systems which relied upon copper metal liners constrained in steel bodies and plastic explosives initiated by single point electric squibs. The preferred perforator 100 has been developed to enhance the penetration of typical hard rock and sandstone formations and ultimately will increase well productivity. There are three independent areas of improved technology that were the major influences relied upon for the principles of this invention. These include heavy metal liner selection and alloy treatment, improved explosive materials, and more thorough detonation techniques. The performance improvements attributed to each of these technical developments will now be discussed.

The metal tube 20 of this invention preferably is a cylindrical metal tube, or charge body, that may be boat-tailed and closed at one end. This tube preferably includes an outer diameter which is about the same size as the well bore, and more preferably about 2⅞ inches, so as to be fired from guns of the substantially same diameter. The tube is an ideal container for the high energy explosive 30, since the explosive can be cast or pressed directly in place to provide a compact, substantially void-free charge. Suitable materials for the cylindrical metal tube include DU or steel.

Figure 2:
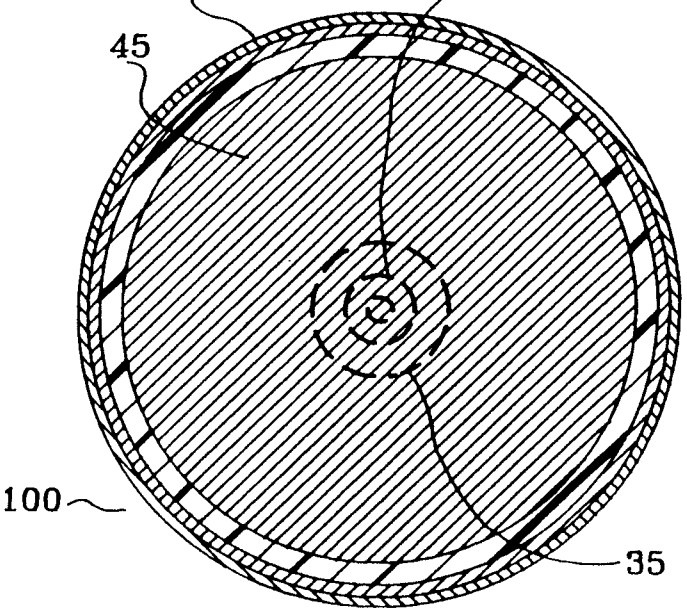
FIG. 2 is a front, cross-sectional view, taken through line 2—2, of the preferred shaped charge perforator of FIG. 1.
Figure 3:
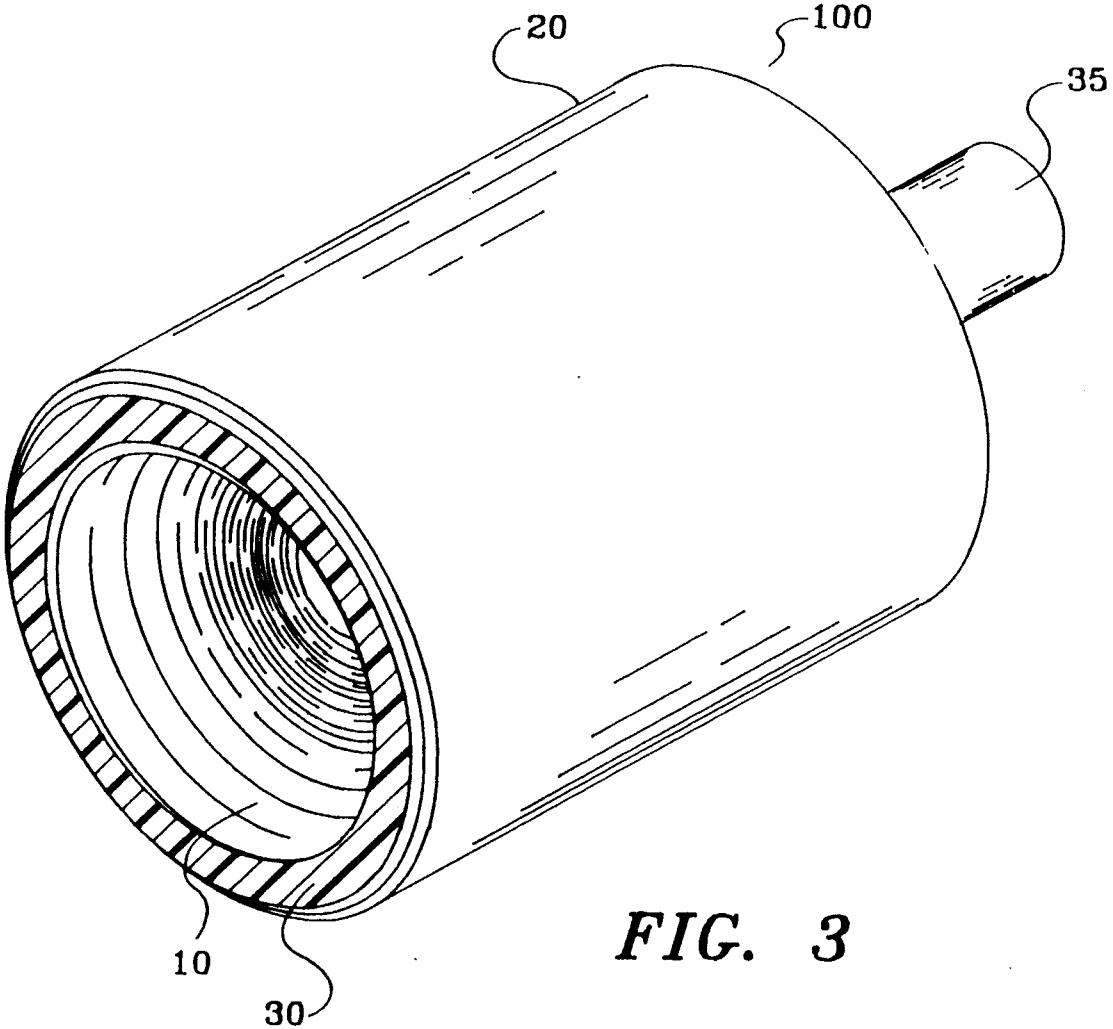
FIG. 3 is a perspective front and side view of the preferred shaped charge perforator of FIG. 1.

In accordance with an important aspect of this invention, heavy metal liners having a concave or conical, depressed shape, such as hemispherical liner 10, are employed at the open end of the tube 20, as shown in FIG. 2. The unconstrained end of the high energy explosive 30 can be formed or cut away to form a concave cavity having various geometrical configurations, which may include, for example, cones, hemispherical segments, etc. The selected shape will be chosen based upon such considerations as the distance to the oil well hole wall and the orientation of the charge within the hole. The unconstrained end of the explosive 30 is fitted with a liner 10 which preferably has an outer diameter or shape which is substantially the same as the inner diameter or shape of the cavity within the high energy explosive 30, so that when the liner 10 is in place, it will conform, as closely as possible, to the surface of the cavity in the high energy explosive 30. Preferably the liner is affixed to the explosive by means of an adhesive, such as a resin-based epoxy.

In another important aspect of this invention, the liner metal desirably employs a high density metal, or "heavy metal", having a density of greater than about 10 g/cc, preferably a density of about 15–20 g/cc, and more preferably about 19 g/cc. Table I below lists the important physical properties of metals which are preferred candidates for use in the liners of this invention, such as DU, W, Mo, Ta, and metals which have been employed as liners in the prior art, for example, Cu and Fe.

TABLE I

COMPARISON OF TYPICAL PROPERTIES OF BASE METAL SHEET USED IN LINERS

| Base Metal | Density (g/cc) | MP (°C.) | Ultimate Tensile Strength (ksi) | Yield Strength (ksi) | % Elongation |
|---|---|---|---|---|---|
| Depleted Uranium | 19.13 | 1130 | 125 | 105 | 50 |

TABLE I-continued

COMPARISON OF TYPICAL PROPERTIES OF BASE METAL SHEET USED IN LINERS

| Base Metal | Density (g/cc) | MP (°C.) | Ultimate Tensile Strength (ksi) | Yield Strength (ksi) | % Elongation |
|---|---|---|---|---|---|
| (DU) | | | | | |
| Tungsten (W) | 19.3 | 3410 | 150 | 120 | 30 |
| Molybdenum (Mo) | 10.2 | 2620 | 100 | 80 | 25 |
| Tantalum (Ta) | 16.6 | 2996 | 40 | 30 | 40 |
| Copper (Cu) | 8.9 | 1080 | 75 | 60 | 35 |
| Iron (Fe) | 7.9 | 1536 | 80 | 65 | 20 |

Since the mean density of rock is generally understood to be about 3 g/cc, the earlier presented penetration formula will yield a higher penetration value, "P", with a liner metal containing DU or W, as opposed to a liner metal containing Cu or Fe. Depleted Uranium has the additional advantage of having a low first ionization potential and a tremendous thermodynamic temperature. Accordingly, a highly chemically reactive Uranium jet is formed upon detonation of a DU liner that reacts with the tube material through which the jet passes, as well as the rock or sandstone.

The liner metal should be very ductile since ductility is roughly proportional to the length, l, of the jet in the penetration equation. The liner metals of this invention desirably include a % elongation, one commonly known measurement for ductility, exceeding 20%, more preferably exceeding 25%, and most preferably exceeding 30%. It has been shown that the dynamic ductility of certain of the heavy metals can be dramatically enhanced by cold-working the material by rolling, drawing, or stamping, for example. Cold-working may introduce a decreased grain size in the metallurgical structure of the metal which results in higher ductility, as measured by % elongation at a given test temperature. It is preferred that the liner metals of this invention be cold-worked to at least about a 50% reduction, and more preferably to over about a 90% reduction.

Figure 4:
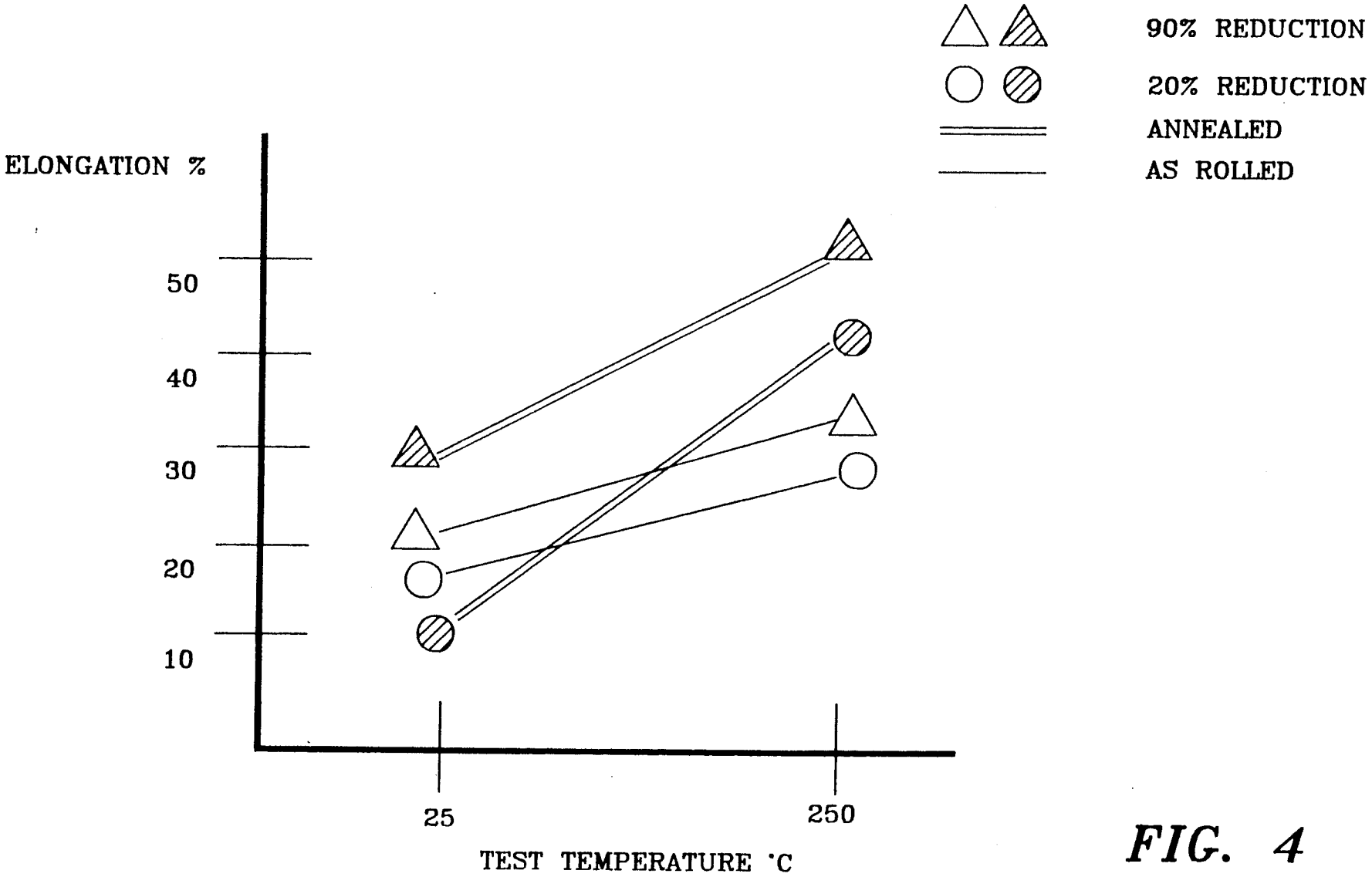
FIG. 4 is a graphical depiction of % elongation versus test temperature (°C.) for depleted Uranium specimens cold rolled to 20% and 90% reduction with, and without, a grain refining anneal heat treatment.

Certain rolling techniques have already been shown to be particularly effective when applied to depleted Uranium, DU, which exhibits an anomalous and potentially useful behavior. Depleted Uranium becomes more ductile as it is cold rolled as depicted in FIG. 4. Upon reducing the thickness of the starting billet or plate by 90% in a rolling operation conducted at 250° C., the room temperature ductility, as measured by % elongation, increases from 5% to 25%. The ductility of depleted Uranium, as well as the other heavy metal liners of this invention, can be further increased by a post-rolling, vacuum anneal at an elevated temperature. This procedure has the potential of increasing the % elongation from about 25% to over 38%.

A second technique that will increase the ductility of selected liner metals of this invention is hot isostatic pressing (HIP). This is a powder metallurgy term which includes preparing a powdered composition of a liner metal, for example, by atomization, followed by heating the powder in a mold under elevated temperature and pressure conditions so that the individual powder particles fuse into one another, without losing their desirable microstructure. With respect to powdered heavy metals, it has been shown that the resulting microstructure is heavily worked and enables ductility enhancements. The fabrication of finished liners from these materials can be achieved by applying HIP technology to near net liner shape, or by forming a billet which is subsequently refined further through a rolling, stamping, or drawing operation. It is understood that the temperatures involved in the HIP cycle are preferably sufficiently low, i.e., below the recrystallization temperature, so as to preserve the fine grain microstructure of the powder.

Table II provides examples of mechanical property data, including Ultimate Tensile Strength (U.T.S.), Yield Strength (Y.S.), % Elongation (% E.), and % Reduction in Area (% R.A.), generated during the manufacturing of Ta shaped charge liners using hot isostatic pressing. This data dramatically shows the enhanced ductility that can be introduced using the HIP techniques with powdered heavy metal.

TABLE II

ENHANCEMENT OF THE MECHANICAL PROPERTIES OF TANTALUM USING HIP

| Description | U.T.S. (psi) | Y.S. (psi) | % E. | % R.A. |
|---|---|---|---|---|
| IMT Direct HIP P/M Fansteel FC-8-4789 | 47,100 | 34.000 | 46 | 89 |
| ASTM B-708 Annealed | 30.000* | 20.000* | 20* | N/A |
| NRC E-Beam Melt | 30.000* | 20.000* | 25* | N/A |
| NRC Arc-Cast ASTM B-365 | 40.000 | 25.000 | 32 | N/A |
| Annealed Road & Wire | 25.000* | 20.000* | 25* | N/A |

*minimum value

In most of today's commercial available shaped charges, a common explosive material, such as C6 plastic explosive is used. This invention prefers to use complex initiation schemes and explosives which employ high energy, but are thermally stable. The factor K in the penetration formula is enhanced significantly by modern military explosives of the high content HMX variety. PBXW-9 (a pressed explosive) and PBX-113 (a homogeneous cast explosive) are preferred high grade explosives of this variety, which are relatively insensitive by Navy explosive standards, and are generally less costly than high energy Army explosives, such as LX-14.

As described in FIGS. 1 and 2, the preferred perforator 100 of this invention includes a detonator for initiating the high energy explosive charge. The detonator preferably comprises a non-point detonating explosive scheme to optimize shock wave propagation. Such detonators are known to include an initiating charge 45, which is preferably a round plate or ring of explosive. This initiating charge 45 provides a more uniform ignition of the high energy explosives 30, as compared with prior art single point electric squibs.

From the foregoing, it can be realized that this invention provides improved shaped charge perforators that will enhance the penetration of typical formations, and improve well productivity, especially in high permeability reservoirs. The enhanced perforation generated by this invention is expected to result in a reduction of the number of shots required to achieve the same production goals and allow enhanced penetration with smaller guns, for example, 2⅞ inch guns. The higher penetration is also expected to allow the charges to overcome many of the difficulties that plague currently employed commercial perforators, including an enhancement in the ability to penetrate multiple casings and cement sheaths employed in washouts, while simultaneously decreasing perforation damage to both the reservoir and casing. Although various embodiments have been illustrated, this was for the purpose of describing, but not limiting, the invention. Various modifications, which will become apparent to one skilled in the art, are within the scope of this invention described in the attached claims.

I claim:

1. A shaped charge perforator, comprising:

a metal tube having a first closed end and a high energy explosive disposed therein, said first closed end containing detonation means for providing an initiating charge to said high energy explosive, said tube having a second end comprising a liner, said liner including a liner metal selected from the group consisting of DU, Ta, W, Mo, or a combination thereof, and having a density greater than 10 g/cc, said liner metal being cold worked to achieve at least a 20% reduction in cross-sectional area, said liner having a room temperature percent elongation of at least 38% and being disposed within a depression in said high energy explosive at said second end of said metal tube.

2. The perforator of claim 1, wherein said liner metal comprises a density of 15–20 g/cc.

3. The perforator of claim 1, wherein said liner metal comprises a density of 19 g/cc.

4. The perforator of claim 1, wherein said cold-working comprises rolling said liner metal to at least a 50% reduction.

5. The perforator of claim 1, wherein said cold-working comprises rolling said liner metal to greater than a 90% reduction.

6. The perforator of claim 1, wherein said liner metal is annealed at an elevated temperature.

7. The perforator of claim 1, wherein said liner metal comprises a powder metallurgy composite.

8. The perforator of claim 7, wherein said powder metallurgy composite comprises a hot isostatic pressed article.

9. The perforator of claim 8, wherein said hot isostatic pressed article comprises a billet, which is subsequently rolled.

10. The perforator of claim 1, wherein said explosive comprises a high density HMX explosive.

11. The perforator of claim 10, wherein said explosive comprises a pressed or cast explosive.

12. The perforator of claim 1, wherein said detonation means comprises initiating charge means comprising an explosive surface for producing shock wave propagation.

13. The perforator of claim 12, wherein said initiation charge means comprises a plate or ring detonating explosive shape.

14. The perforator of claim 12, wherein said initiation charge means comprises a detonator and booster charge.

15. The perforator of claim 1, wherein said liner comprises a hemispherical concave shape.

16. The perforator of claim 15, wherein said liner is adhesively attached to said high energy explosive.

17. A shaped charge perforator, comprising a metallic charge body having a circular cross section and having a first closed end, said charge body comprising a high energy HMX explosive disposed therein, said first closed end containing a detonator having a detonating charge configuration, said perforator also comprising a liner having a room temperature percent elongation of at least 38% and disposed at a second end of said charge body, said liner comprising a liner metal selected from the group consisting of DU, Ta, W, Mo, or a combination thereof, and having a density greater than 10 g/cc, said liner metal being cold worked to achieve at least a 20% reduction in cross-sectional area, said liner disposed within a depression in said high energy explosive at said second end of said charge body.

18. A shaped charge perforator, comprising a metal tube having a first closed end and containing a high energy explosive having a concave cavity surface thereon, said first closed end containing a detonating charge for igniting said high energy explosive, said tube further comprising a metallic liner having a room temperature percent elongation of at least 38% and disposed at a second end thereof, said liner adhesively attached to conform to said cavity surface of said high energy explosive, said liner comprising a liner metal selected from the group consisting of DU, Ta, W, Mo, or a combination thereof, and having a density of 15–20 g/cc, a fine grain microstructure, said liner metal being cold worked to achieve at least about a 20% reduction in cross-sectional area.

* * * * *